US007287825B2

(12) United States Patent
Furuichi et al.

(10) Patent No.: US 7,287,825 B2
(45) Date of Patent: Oct. 30, 2007

(54) PRELIMINARY EJECTION METHOD AND INK JET PRINTING APPARATUS

(75) Inventors: Tomomi Furuichi, Yokohama (JP); Rie Takekoshi, Kawasaki (JP); Daigoro Kanematsu, Yokohama (JP); Naoko Baba, Kawasaki (JP); Kazuo Suzuki, Yokohama (JP); Mitsutoshi Nagamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 11/150,113

(22) Filed: Jun. 13, 2005

(65) Prior Publication Data

US 2005/0275683 A1 Dec. 15, 2005

(30) Foreign Application Priority Data

Jun. 15, 2004 (JP) ..... 2004-177374

(51) Int. Cl.
*B41J 2/165* (2006.01)

(52) U.S. Cl. ..... 347/24; 347/23; 347/19

(58) Field of Classification Search ..... 347/24, 347/30, 35, 23, 19, 5, 9
See application file for complete search history.

(56) References Cited

U.S. PATENT DOCUMENTS 5,659,342 A * 8/1997 Lund et al. ..... 347/35
6,565,186 B1 * 5/2003 Hattori et al. ..... 347/24
2005/0275687 A1 12/2005 Furuichi et al.

FOREIGN PATENT DOCUMENTS

JP 55-139269 10/1980

* cited by examiner

*Primary Examiner*—Lam Son Nguyen
(74) *Attorney, Agent, or Firm*—Fitzpatrick, Cella, Harper & Scinto

(57) ABSTRACT

In an ink jet printer in which preliminary ejection is performed onto printing paper, unnecessary ink consumption due to the preliminary ejection is suppressed. More specifically, the paper preliminary ejection is designed to be performed only for a printing head of cyan ink. For this cyan ink the longest duration of its non-ejection state, in which the printer can attain high printing quality when restarting printing after continuation of the non-ejection state in the case of not performing the paper preliminary ejection, is shorter than 1.6 seconds of the duration which is necessary for the reciprocal printing. This eliminates the paper preliminary ejection for the printing heads of the other colors of ink, thereby avoiding unnecessary ink consumption due to the paper preliminary ejection performed uniformly for every color of ink.

3 Claims, 12 Drawing Sheets

DEVELOPMENT PATTERN OF INDEX LEVEL "0001"

PRELIMINARY EJECTION METHOD AND INK JET PRINTING APPARATUS

BACKGROUND OF THE INVENTION

1. Field of the Invention

The present invention relates to an ink jet printing method and an ink jet printing apparatus and, more particularly, to an ink jet printing method and an ink jet printing apparatus for performing so-called preliminary ejection, in which ink is ejected from a printing head unrelated to printing, while printing an image.

Also, the present invention can be applied to apparatuses such as a printer, a copying machine, a facsimile machine having a communication system, a word processor having a printer section and so on for printing on a medium to be printed such as paper, yarn, fiber, fabric, metal, plastic, rubber, glass, wood, ceramics and so on and, moreover, industrial printing apparatuses combined complexly with various processing units.

It should be appreciated that "printing" in the present specification means not only to afford images having a meaning such as characters and graphics to the medium to be printed, but also to afford images having no meaning such as patterns.

2. Detailed Description of the Related Art

The preliminary ejection is performed to discharge highly viscous ink and dust in an ink ejection orifice of a printing head through ink ejection thereof so as to keep the ejection performance of a printing head satisfactory. It is also executed for avoiding density unevenness on a printed image by ejecting ink whose concentration of color material such as dye and pigment has increased. A usual manner of such preliminary ejection is that, in the case of serial method of printing by causing the printing head to scan, the ink ejection is performed, for the preliminary ejection, to an ink receptacle disposed at one end of the scanning area. Further, in the case of full line method for printing by moving a printing medium with respect to a printing head whose ink ejection orifices are arranged in correspondence to the width of the printing medium, the ink receptacle is moved relatvely to the printing head to oppose thereto and ink is ejected to the same.

On the other hand, those of which ink is ejected for the preliminary ejection while an image is printed on the printing medium are also known. For instance, it is described to perform the preliminary ejection at a constant frequency for the Ink ejection for printing, in Japanese Patent Application Laid-Open No. 1980-139269. According to such preliminary ejection, it is not necessary for the printing head to move for preliminary ejection as in the case of performing the preliminary ejection to a predetermined ink receptacle disposed in the printer. Therefore, it becomes possible to prevent the throughput of printing from lowering as much. Even when the ejection is not performed for certain ejection orifices during the printing in relation with the printing data, the preliminary ejection can be performed for these ejection orifices, because this method for performing the preliminary ejection to the printing medium (also referred as "paper preliminary ejection" in the present specification) is performed, basically, with accompanying the ink ejection for printing an image. More specifically, during the printing, the printing is performed in a state where the printing head is not covered with a cap or the like and the ejection orifice part is exposed, and in this case, even when the ejection is not performed for certain ejection orifices according to the printing data, the ink ejection through preliminary ejection can be performed for these ejection orifices, allowing to effectively prevent ejection failure due to the exposed state.

Particularly, the paper preliminary ejection is effective in the case of printing on a relatively large sized printing medium. More specifically, in the case of printing on a large sized printing medium, the throughput tends to lower because as much time is necessary for the printing head to scan. However, the paper preliminary ejection can partly replace normal preliminary ejection, which is performed at a predetermined position in a printing apparatus, or can be performed in place of the normal preliminary ejection. Thereby, time period for the normal preliminary ejection can be decreased as much and thus lowering of the throughput can be prevented. In addition, on focusing attention on an ejection orifice in the printing head, a non-ejection state of the ejection orifice, for which print data represents "non-ejection", may continue, and then ink ejection from the ejection orifice may be executed by that the print data represents "ejection" during scanning of the printing head in the non-ejection state. In such case, when printing on a large sized printing medium, the ejection orifice in the printing head remains exposed for a long period of time. For this condition, the paper preliminary ejection is performed and then first ejection for printing after the exposed state can be well executed.

However, when the paper preliminary ejection is performed for different colors of inks without variation, unnecessary preliminary ejection may be performed and ink may be used wastefully. More specifically, a property of ink affecting ink ejection by the printing head, such as a degree of viscosity increasing of ink, generally depends on colors of ink. In such case, when the paper preliminary ejection of a constant period is performed for a plurality of colors of inks without variations, the paper preliminary ejection for the ink which does not increase viscosity during such constant period is also performed, and then the ink as much is used wastefully.

Particularly in the case of using both the normal preliminary ejection which is performed at a predetermined location in a printing apparatus and the paper preliminary ejection, there may be a case that depending on a color of ink, an ejection performance of a printing head for ejecting the color of ink can be maintained well only by the normal preliminary ejection. In this case, it is desirable that the paper preliminary ejection for the color of ink is not performed in terms of decreasing ink use for the preliminary ejection. A reason that properties of inks, such as viscosity increasing, affecting ink ejection by the printing head differ depending on colors of ink is that the properties differ depending on color materials in ink such as dye and pigment, and contents of the color materials of the same color inks, and further differ depending on other solvent in ink.

Further, the above discussion is the case with ejection amounts different for each printing head. Generally, the greater an amount (a volume of an ink droplet) of one time ejection is, the longer the time period during which a factor causing a ejection failure, such as increasing of ink viscosity, does not occur. Therefore, when the paper preliminary ejection of the constant period is performed for the plurality of colors of ink without variations, ink may be used wastefully for the printing head ejecting such greater amount of ink.

SUMMARY OF THE INVENTION

The present invention can provide a preliminary ejection method and an ink jet printing apparatus which can perform paper preliminary ejection in which unnecessary ink use is suppressed.

In a first aspect of the present invention, there is provided a paper preliminary ejection method, which is used in an ink jet printing apparatus in which ink is ejected from a printing head for ejecting a plurality of kinds of ink to a printing medium to print an image, for performing ink ejection of no concern to the image to be printed to the printing medium, the method comprising:

step for ejecting ink to the printing medium based on image data corresponding to the image to be printed to print the an image; and step for causing the printing head to execute preliminary ejection to the printing medium, based on conditions related to the preliminary ejection, wherein the conditions are individually determined for respective kinds of ink, and the conditions are different between a kind of ink and other kind of ink within the plurality of kinds of ink.

In a second aspect of the present invention, there is provided a paper preliminary ejection method, which is used in an ink jet printing apparatus in which ink is ejected from a printing head for ejecting a plurality of kinds of ink to a printing medium to print an image, for performing ink ejection of no concern to the image to be printed to the printing medium, the method comprising:

step for, for each of the plurality of kinds of ink, determining information on predetermined time periods for each of plurality of frequencies for paper preliminary ejection including a lowest frequency at which no paper preliminary ejection is performed, the predetermined time period being defined as a time period elapsing after an operation of discharging ink from the printing head with the paper preliminary ejection being performed at the corresponding frequency, after the time period having been elapsed and upon starting of printing a predetermined image, no predetermined degradation of printed image occurring: and step for, for each of the plurality of kinds of ink, comparing the predetermined time period for each of the plurality of frequencies with a time period from the operation of discharging ink to the next operation of discharging ink, and when the predetermined time period is shorter than the time period from the operation of discharging ink to the next operation of discharging ink, the performing the paper preliminary ejection at the frequency higher than the frequency corresponding to the predetermined time period for the corresponding ink.

In a third aspect of the present invention, there is provided an ink jet printing apparatus in which ink is ejected from a printing head for ejecting a plurality of kinds of ink to a printing medium to print an image, the apparatus comprising:

means for performing a preliminary ejection based on conditions related to the preliminary ejection that ejects ink of no concern to the image to be printed to the printing medium, wherein the conditions are individually determined for respective kinds of ink, and the conditions are different between a first ink and a second ink within the plurality of kinds of ink.

According to the present invention, conditions for paper preliminary ejection are individually set for plurality kinds of ink. Thereby, minimum amount of paper preliminary ejection can be performed for each of the plurality of kinds of ink.

As a result, the paper preliminary ejection in which unnecessary ink use is suppressed can be performed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail referring to accompanying drawings. A printer shall be illustrated as an ink jet printing apparatus, in the embodiments described below.

Figure 1:
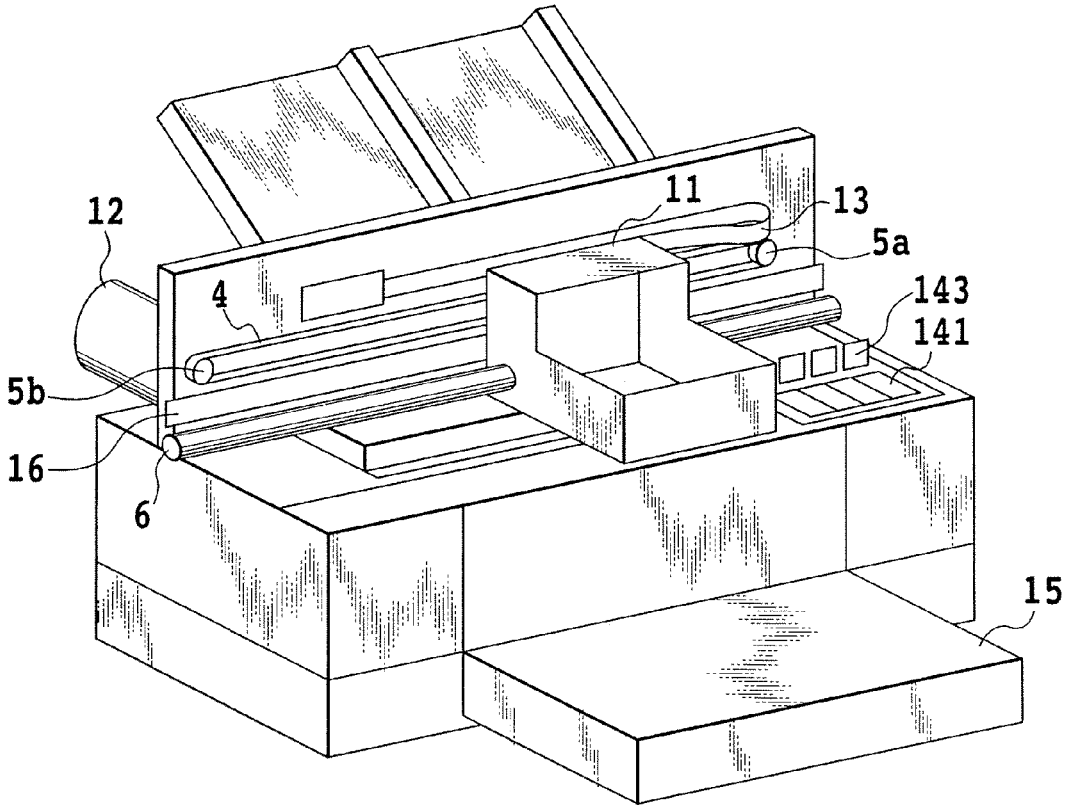
FIG. 1 is an exterior perspective view showing a schematic composition of an ink jet printer according to one embodiment of the present invention.

FIG. 1 is an exterior perspective view showing a schematic composition of an ink jet printer according to one embodiment of the present invention. As illustrated, in the printer, a printing head scans a printing medium through back-and-forth motion (this moving direction is refeffed as "main scanning direction") of a carriage 11 detachably mounting a head cartridge integrating the printing head and an ink tank for storing ink. During this scanning, the printing is performed by ejecting ink on a printing medium such as printing paper. A carriage motor 12 constitutes a driving source for moving the above carriage 11, and the driving force thereof is transmitted to the carriage via a belt 4 and pulleys 5*a*, 5*b*. A guide shaft 6 guides and supports the carriage 11 when it moves in the main scanning direction. An ejection signal or the like for ink ejection by the printing head is transferred to the printing head as an electric signal from a control section mentioned below in FIG. 4, through a flexible cable 13. A cap 141 and a wiper blade 143 perform capping and wiping of the printing head, respectively, and they are used for ejection recovery operation. A cassette 15 stocks printing medium (for instance, printing paper) in a layered state, while an encoder sensor 16 and an encoder film read optically the moving position of the carriage 11.

Figure 2:
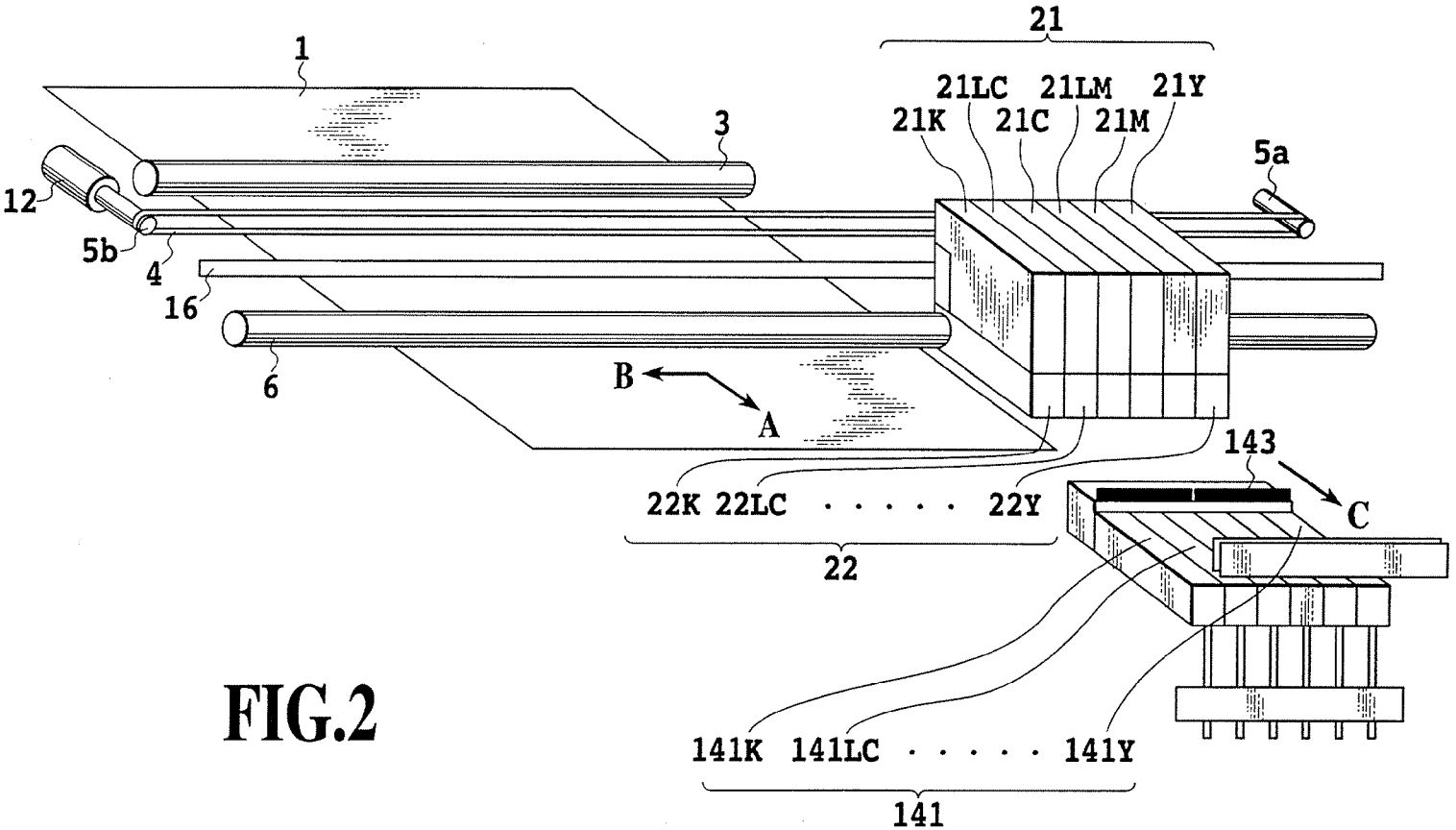
FIG. 2 is a perspective view showing in detail a composition of vicinity of the carriage in the ink jet printer shown in FIG. 1.

FIG. 2 is a perspective view showing in detail a composition of a vicinity of the carriage in the ink jet printer shown in FIG. 1. In FIG. 2, the printing head 22 is composed integrally with the ink tank as mentioned above, and mounted detachably on the carriage 11 in the present embodiment. There, this printing head 22 is composed of six printing heads 22K, 22C, 22M, 22Y, 22LC and 22LM ejecting six inks respectively in total including black (K), dark cyan (C), dark magenta (M) and yellow (Y) as well as light cyan (LC) and light magenta (LM) of lower colorant concentration than dark inks mentioned above. The ink tank 21 is composed of six ink tanks 21K, 21LC, 21C, 21LM, 21M, 21Y for storing ink to be fed to the respective printing heads 22K, 22LC, 22C, 22LM, 22M, 22Y. And, the respective printing heads and ink tanks are formed integrally for each ink of their corresponding colors to compose a head cartridge. Caps 141, corresponding to six colors of inks, are disposed at the home position in the vicinity of one end of the moving range of the carriage 11 equipped with these cartridges. More specifically, the cap is composed of six caps 141K, 141LC, 141C, 141LM, 141M and 141Y so as to cover respective ink ejection faces of the six printing heads. It should be appreciated that these reference numbers given to respective elements are used for referring separately to these printing heads or ink tanks, and collective reference numbers such as "22" for the printing head, "21" for the ink tank and "141" for the cap are used where they are referred to collectively. It goes without saying that the printing head and the ink tank may also be detachable individually with respect to the carriage, though they are composed of an integral head cartridge in the aforementioned example.

Figure 3:
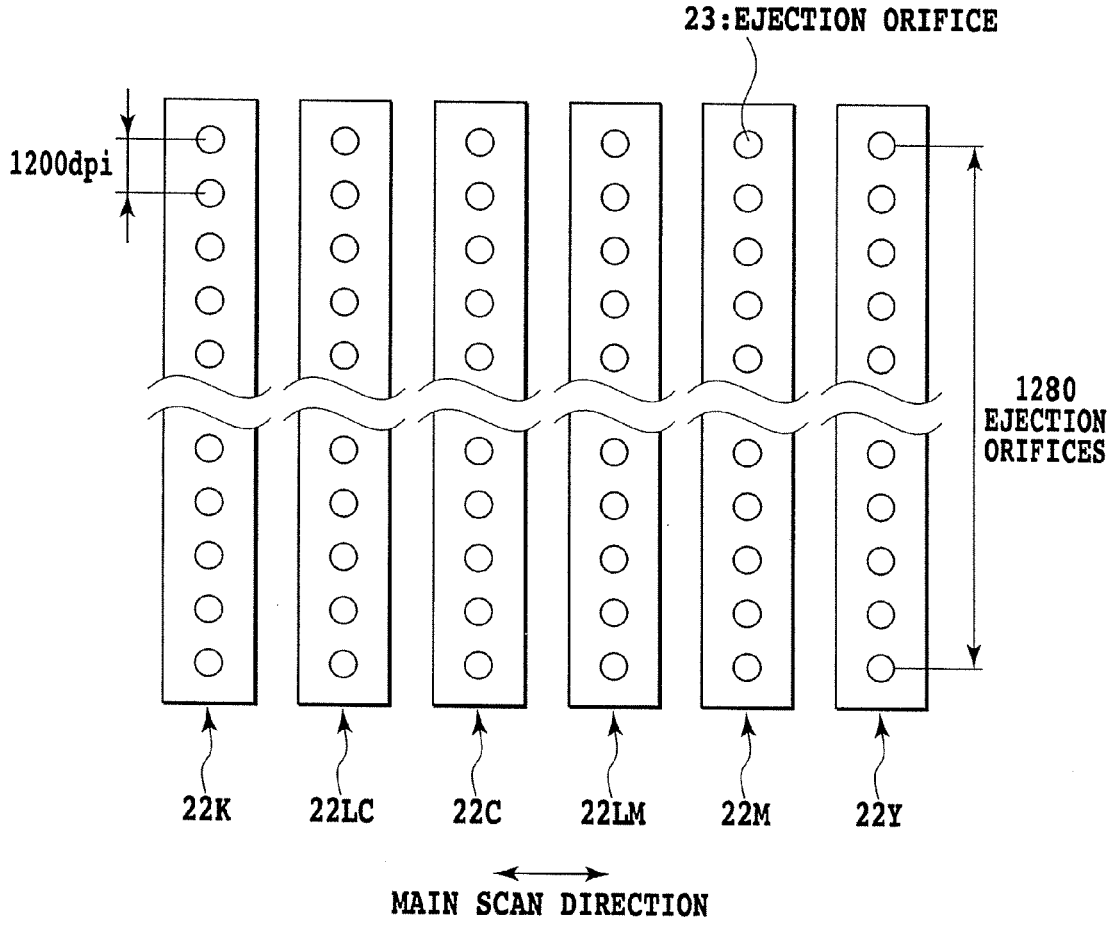
FIG. 3 is a diagram showing the printing head of FIG. 2 viewed from the ejection orifice side.

FIG. 3 is a diagram showing the printing head 22 viewed from the ejection orifice side. As shown in FIG. 3, printing heads 22K, 22LC, 22C, 22LM, 22M, 22Y have 1280 ejection orifices disposed approximately orthogonal to the main scanning direction with a density of 1200 dpi respectively. These six printing heads are mounted on the carriage 11 in a way to be arranged in the main scanning direction. Ink amount of about 4 ng is ejected at one time of ejection from each of ejection orifices 23.

The printing operation of the ink jet printer of the present embodiment described above referring to FIG. 1 to FIG. 3 is generally as follows.

When printing starts, printing papers 1 stacked in the cassette 15 are fed one by one to a printing area by a paper feed roller (not shown). Then, the printing head 22 scans in the printing area, and the printing paper is fed by a predetermined amount by a pair of transport rollers 3, on a platen (not shown) installed in an area to which the printing head 22 faces. On the other hand, ink is fed from the ink tank 21 to the printing head 22 and the printing head 22 ejects the ink on the printing paper 1 based on printing data, while scanning in the arrow B direction (forth scanning direction) of FIG. 2 to perform printing in a width corresponding to a predetermined number of ejection orifices of the printing head 22. Ink ejection in this printing is performed by driving the printing head according to the read timing of the encoder 16. Then, when the printing corresponding to one scan in the arrow B direction (forth scanning direction) is completed, the printing head 22 returns to the original home position and prints again in the arrow B direction (forth scanning direction). After the completion of one printing operation (one scan) in one direction, the printing paper 1 is fed in the arrow A direction by the predetermined amount which is the width corresponding to the predetermined number of the aforementioned ejection orifices by driving the pair of transport rollers 3, before the next printing operation starts. An image is printed on the printing paper 1 by repeating the printing operation of one scan and the feeding the paper by the predetermined amount in this manner.

The printing head 22 returns to the home position at a predetermined timing such as that before starting the printing, and performs a recovery operation by a recovery mechanism. More specifically, the ejection orifice face of the printing head 22 is capped with the cap 141 and ink in the ejection orifice 23 is sucked. Also, the above capping is performed during the non-printing, to prevent the ink from drying. Moreover, a wiper blade 143 wipes the ejection orifice 23 face of the printing head 22 by moving in the arrow C direction, to remove the ink attached to the ejection orifice face.

Further, as described later for FIG. 7, paper preliminary ejection, for ejecting ink on the printing paper along with the printing operation is performed as preliminary ejection in the embodiment of the present invention. Moreover, an ink receptacle is installed at a position adjacent to the home position in order to perform the preliminary ejection before starting the printing and so on in the present embodiment, and the preliminary ejection is performed at a predetermined timing such as that before the printing start.

Figure 4:
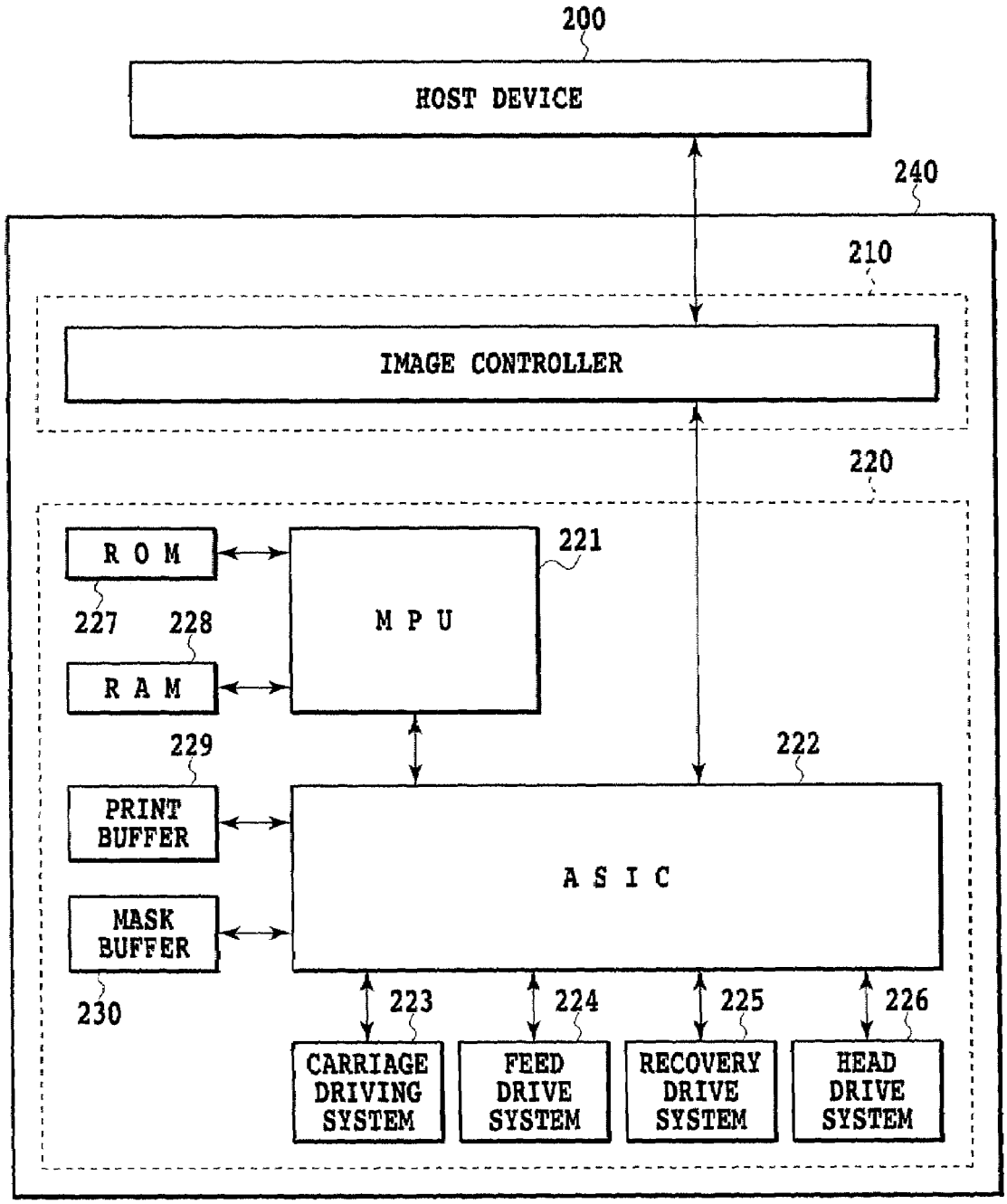
FIG. 4 is a block diagram showing a configuration of the control system in the ink jet printer of the present embodiment.

FIG. 4 is a block diagram showing a configuration of the control system of the ink jet printer of the present embodiment described above. In FIG. 4, an image controller 210 notifies a print engine control section 220 of a control command according to the processing command signal from a host device 200 or an operation section of a printer (not shown). Moreover, during the printing, printing data received from the host device 200 is analyzed, developed and converted into binary image data for respective colors. The print engine control section 220 performs the printing operation based on the control command and the image data sent from the image controller 210. The image controller 210 and the print engine control section 220 are connected by a dedicated interface, allowing to perform a communication comprising the command transmission for notifying a control command from the image controller 210 to the print engine control section 220 and the status transmission for informing of the state variation of the image controller 210 from the print engine control section 220, and the image data transfer from the image controller 210 to the print engine control section control section 220.

In the print engine control section 220, an MPU (Micro Processor Unit) 221 executes various operations, according to programs stored in a ROM 227. A RAM 228 serves as a working area and a temporary data storage area of the MPU 221. The MPU 221 controls a carriage driving system 223, a feed drive system 224, a recovery drive system 225 and a head drive system 226 via an ASIC (Application Specific Integrated Circuit) 222. Also, the MPU 221 is designed to read from and write to a print buffer 229 and a mask buffer 230 that can be read and written from the ASIC 222.

The print buffer 229 temporarily stores those image data converted into a format to be transferred to the printing head. The mask buffer 230 temporarily holds a predetermined mask pattern for exerting the AND processing to the data as necessary for multi-path printing when transferring from the print buffer 229 during the transfer to the printing head. It should be appreciated that several sets of mask patterns are available in the ROM 227 for multi-path printing different in the number of paths, a concerned mask pattern is read out from the ROM 227 during the actual printing, to be stored in the mask buffer 230. The AND processing with the mask buffer 229 is composed not to be executed when unnecessary as in the case of a single path printing.

In the aforementioned composition, the printing operation starts when image data are sent from the host device 200 to the image controller 210. The image controller 210 analyzes the image data received from the host device 200, generates printing quality, margin information or other information necessary for printing and moreover analyzes and develops the image data for starting the conversion into the binary image data of respective colors. Along with the development processing of these image data, information necessary for printing by the print engine control section 220 such as printing quality and margin information is transmitted to the print engine control section 220. Then, in the print engine control section 220, this transmitted information is processed by the MPU 221 via the ASIC 222 and held by the RAM 228. Thereafter, this information is referred to as necessary and used for segmenting the process. Furthermore, the mask pattern is written in the mask buffer 230 as necessary.

When the notification of necessary information is terminated, the image controller 210 starts to transfer the binary printing data of respective colors converted from the image data to the print engine control section 220. The print engine control section 220 writes the transferred printing data in the print buffer 229. And, as will be described later in FIG. 7, the OR (logical sum) of these written printing data and preliminary generated data for paper preliminary ejection is obtained to generate new printing data. The paper preliminary ejection can be performed during the printing, by printing based on the printing data to which these preliminary ejection data are added. Printing data to be transferred to the printing head is held successively in the print buffer 229 of the print engine control section 220, by repeating such printing data transfer from the image controller 210.

When the printing of data held in the print buffer 229 attains such a quantity that allows printing of the actual band data, the MPU 221 transports the paper by the carrying drive system 224 via the ASIC 222 and, at the same time, moves the carriage 11 by the carriage driving system 223. Also, the recovery system is driven by the recovery drive system 225 for performing the recovery operation necessary before the printing operation. Furthermore, image output position and others are set for the ASIC 222 and the carriage 11 is driven to start the printing operation. When the carriage 11 moves and attains the printing start position set in the ASIC 222, printing data to which the aforementioned paper preliminary ejection pattern is added are read consecutively from the print buffer 229, in accordance with the ejection timing. Corresponding mask patterns are read from the mask buffer 230 as necessary. Then the AND (logical product) of the printing data read out and the mask data is determined and transferred to the printing head. In the printing head, the ejection is performed by driving the printing head according to the transferred data, under the control of the head driving system 226. Thus, for instance, a printing of one page is performed by repeating the processing of receiving the printing data from the image controller 210 and thereafter performing the printing process for each band.

Figure 5:
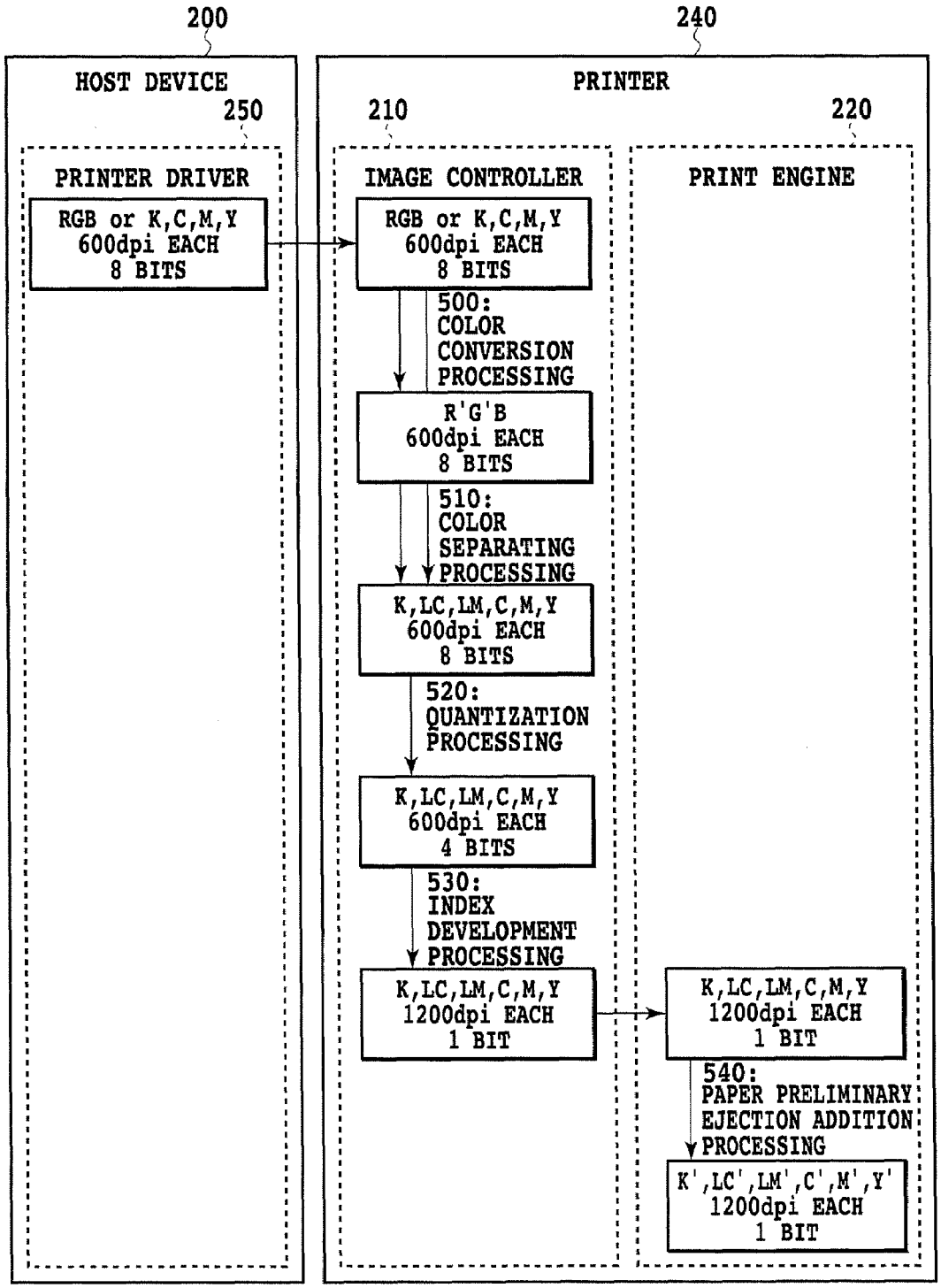
FIG. 5 is a diagram illustrating data processing in the host device 200 and the printer 240 mentioned in FIG. 4.

FIG. 5 is a diagram illustrating data processing in the host device 200 and the printer 240 described above in FIG. 4.

A printer driver 250, software for controlling the printer, is preliminary installed in the host device 200, and activated when a user intends to print a desired image. First, the printer driver 250 generates multi-value image data (here, respectively 8 bits) in RGB (red, green, blue) or KCMY (black, cyan, magenta, yellow) format of 600 dpi×600 dpi and transfers them to the printer. If the received image data are of RGB format, the image controller 210 performs a color conversion processing 500 from RGB to R'G'B' in order to render a color space appropriate for the printer. Next, a color separating processing 510 is performed respectively from 8-bit data of R'G'B' to multi-value data (here, respectively 8 bits) of K, LC, LM, C, M, Y of 600 dpi×600 dpi for adapting to the ink color used by the printer. On the other hand, if data received by the image controller 210 are of KCMY format, a color separating processing 510 is performed without performing the color conversion processing 500. Thus, respective color data corresponding to the ink color to be used by the printer is generated in the color conversion processing 500 independently of the data format generated by the printer driver 250. Colors are converted by means of a look-up table for a predetermined color conversion, in the color conversion processing 500 and the color separating processing 510. The look-up table may be held preliminary in ROM data in a printer main body, and the processing may also be executed based on the table transferred from the host device 200 with the printing data.

Following this, a quantization processing 520 from 8-bit (255 gradation values) data of K, LC, LM, C, M, Y to 4-bit (5 gradation values) for respective colors is performed. The quantization processing 520 is performed by using publicly known error dispersion method or dither method. The 4-bit (5 gradation values) data of quantized K, LC, LM, C, M, Y is submitted to an index development processing 530 mentioned below in FIG. 6, and converted into printing data of 1-bit (2 gradation values) for respective colors of K, LC, LM, C, M, Y. The converted printing data are transferred to the print engine control section 220.

Figure 6:
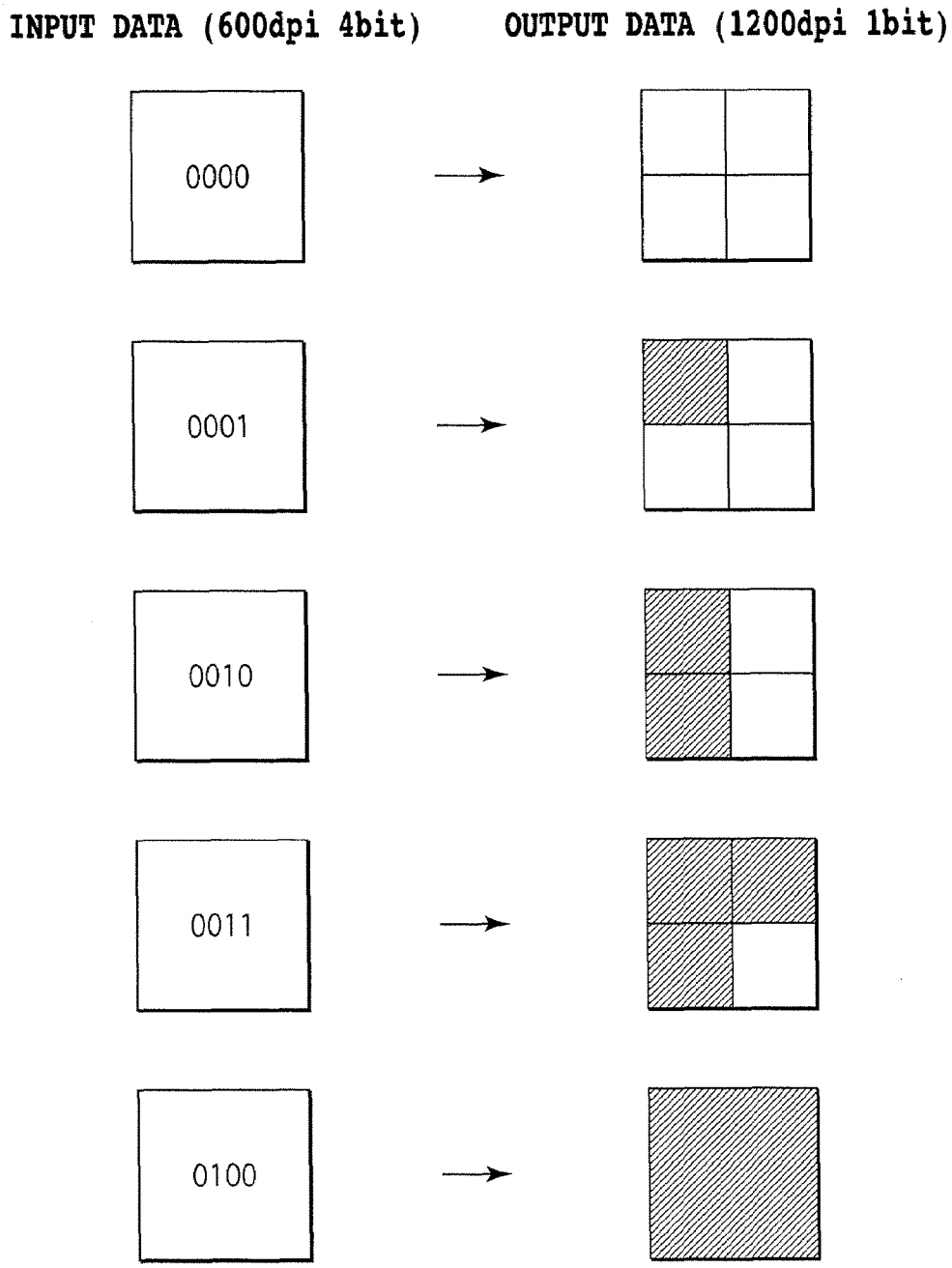
FIG. 6 is a diagram illustrating an index development shown in FIG. 5.

FIG. 6 is a diagram illustrating the index development described above. In general, the index development has an object to reduce the processing load in the RGB multi-value data phase and, at the same time, improve the graduation and, thereby, permits to assure the compatibility of processing speed and image quality In the present embodiment, the image controller 210 submits 4 bit (5 gradation values) data of 600 dpi to the index development to obtain 1-bit (2 gradation values) data of 1200 dpi. Consequently, the matrix size to be developed is 2 (lateral)×2 (vertical). As illustrated, a pattern to be developed by 4-bit data ("0000", "0001", "0010", "0011", "0100") for 5 gradation values is set beforehand for the same. This setting pattern may be held in the ROM of the printer, or, downloaded from the host device together with the image data. 4-bit data of 600 dpi are developed by pixel unit based on the pattern of respective graduation level sets as mentioned above, to generate 1-bit (2 gradation values) data of 1200 dpi In the print engine control section 220 preliminary ejection data are added as paper preliminary ejection generated beforehand as described later by OR (logical sum) to the data of 1-bit (2 gradation values) for respective colors of thus developed K, LC, LM, C, M, Y.

Figure 7:
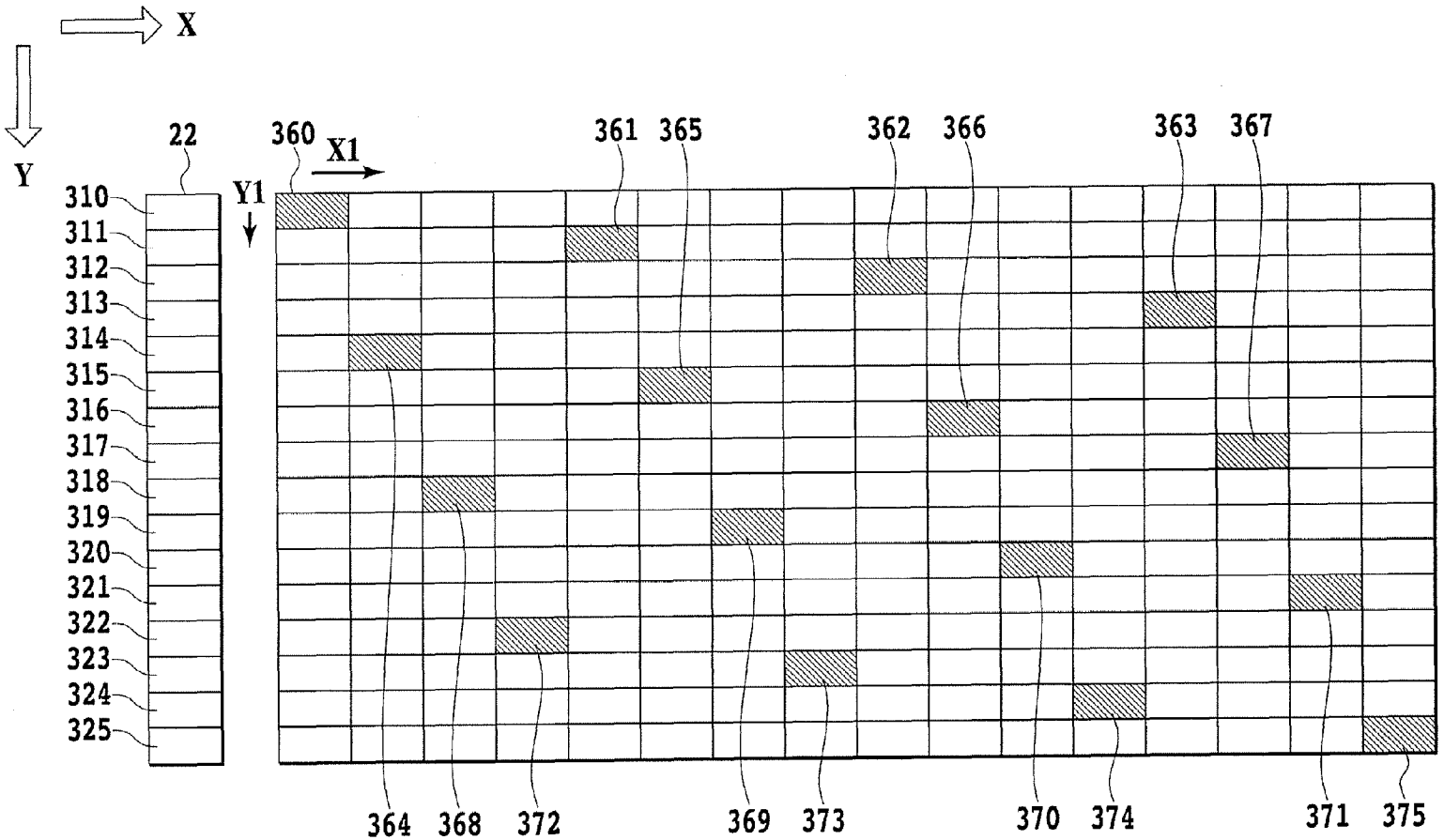
FIG. 7 is a diagram showing the printing data for paper preliminary ejection added in the embodiment of the present invention, through a pattern of pixel arrangement.

FIG. 7 is a diagram showing printing data of the paper preliminary ejection to be added through a data pattern arranged in the pixel.

The pattern of this FIG. 7 shows a basic pattern for an ink of one color. More specifically, as described after with reference to FIG. 8 and subsequent drawings, the paper preliminary ejection is not performed for all kinds of inks used in the printing apparatus of the embodiment but is performed for the kind of ink in which the ejection failure occurs due to viscosity of ink increased during a predetermined time period at which the normal preliminary ejection is performed. It should be appreciated that the number of ejection orifices in the printing head is set to 16, less than the reality, to simplify the description and reference signs 310 to 325 of the printing head 22 represent 16 respective ejection orifices.

Further, the resolution of the paper preliminary ejection pattern is equal to that of the binary data and, in the present embodiment, the resolution in Y direction is supposed to be 1200 dpi, equal to the resolution of the printing head, and also 1200 dpi in X direction. Reference numeral 360 represents the original point (X0, Y0) of the target pixel. In the case of forming an additional dot of preliminary ejection to this target pixel, ink ejection from an ejection orifice 310 will be applied. The pixel of coordinates (X0+X1, 1) gained by shifting by X1 pixels in the X direction and 1 pixel in the Y direction from the original point 360 is a target pixel 361 to which ink from the ejection orifice 311 is applied. Similarly, the pixel of coordinate (X0+2×X1, 2) gained by shifting by X1 pixels in the X direction and 1 pixel in the Y direction from the target pixel 361 to which ink is added by the ejection orifice 311 is a target pixel 362 to which ink from the ejection orifice 312 is applied. Further, the pixel of coordinate (X0+3×X1, 3) gained by shifting by X1 pixels in the X direction and 1 pixel in the Y direction from the target pixel 362 is a target pixel 363 to which ink from the ejection orifice 313 is applied. In the pattern, when becoming Y0+3=Y1−1, the target pixel 364 to which ink from the ejection orifice 314 is added is repeated as (X0+X1, Y1). Thus, pixels in which ink is ejected for preliminary ejection can be determined all over the printing area, by repeating a paper preliminary ejection pattern of a size of 4×X1 pixels in the X direction and 4×Y1 pixels, which is a pattern unit for performing paper preliminary ejection to all of 16 ejection orifices, for the ink of one color.

In the case where the paper preliminary ejection is performed for plurality kinds of ink, the pattern of paper preliminary ejection for them can be described with four parameters of original point X0, Y0, distances X1 and Y1 between dots, for each color. Obviously, the aforementioned pattern of paper preliminary ejection is an example, parameters of other forms may also be used for realizing other patterns of paper preliminary ejection, and, a pattern may be expressed without using parameters.

First Embodiment

The first embodiment of the present invention is set to perform the paper preliminary ejection for only cyan ink out of cyan, magenta, yellow, black, light cyan and light magenta. More specifically, the present embodiment is set to perform so-called normal preliminary ejection, in which preliminary ejection is executed into an ink receptacle in the vicinity of the home position for each reciprocal scanning of a printing head. In this case, as mentioned below, if it is set to perform the normal preliminary ejection for each reciprocal scanning, there may be a color of ink which may possibly cause ejection failure due to increased viscosity if no ejection is executed during reciprocal scanning. In the present embodiment the cyan ink corresponds to that ink. Therefore, the paper preliminary ejection is executed only for this cyan ink. In other words, the number of colors of ink that require execution of the paper preliminary ejection may possibly increase, in an apparatus where the interval for executing the aforementioned normal preliminary ejection is set longer, and in such a case, it goes without saying that the paper preliminary ejection is to be also executed according to the present invention for those colors of ink. Thus, the application of the present embodiment is relative with respect to the interval for executing normal preliminary ejection, and ink requiring the paper preliminary ejection is determined according to that interval.

Figure 8:
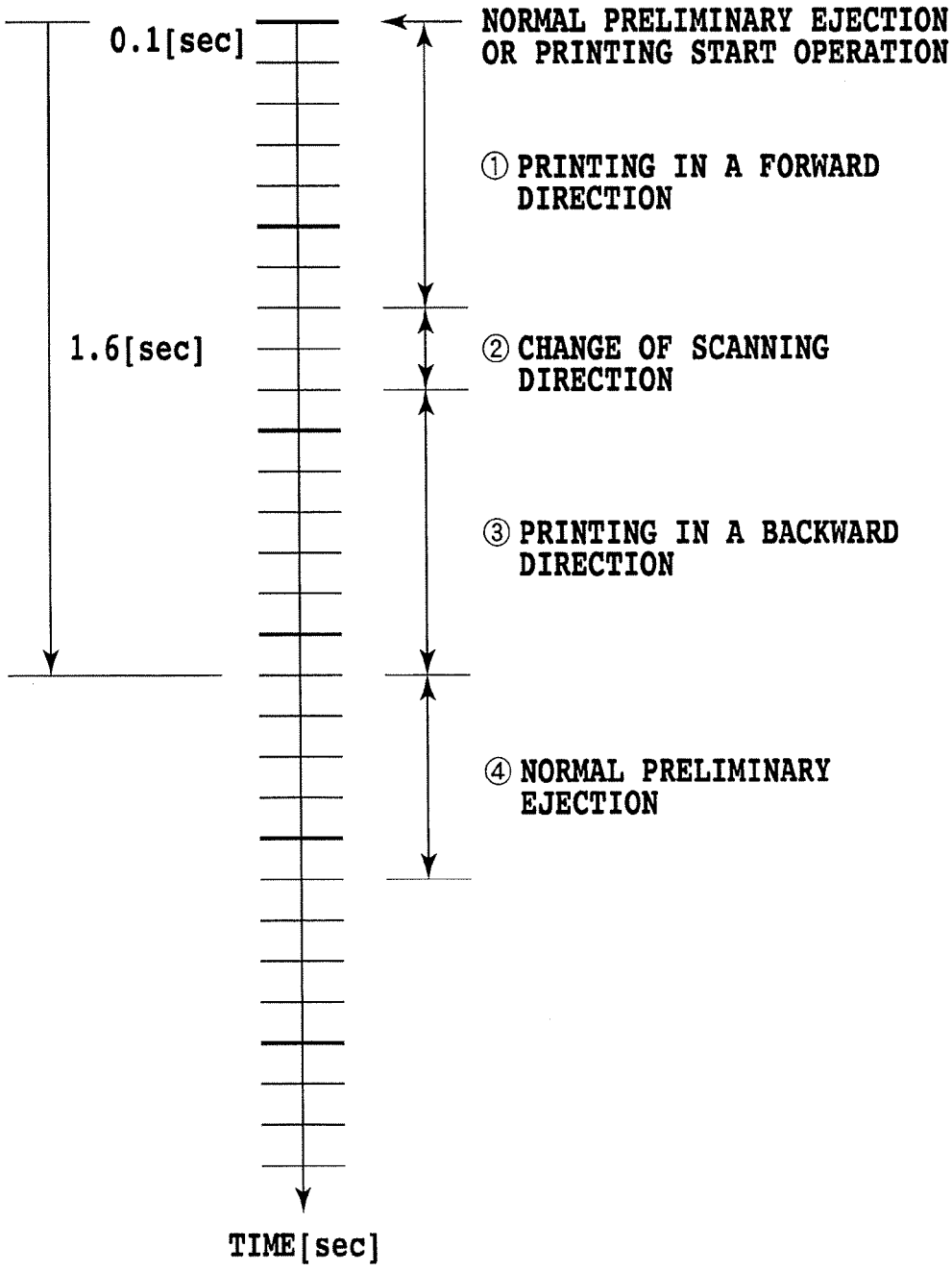
FIG. 8 is diagram especially illustrating time period from a normal preliminary ejection to the next normal preliminary ejection in a printing operation according to an embodiment of the present invention.

FIG. 8 shows the printing operation of the present embodiment along a time axis. In the present embodiment, a carriage 11 (refer to FIG. 1) moves at a speed of 12 inch/sec for scanning of the printing head performed and the printing is executed through the bidirectional scanning thereof. Then, the printing head is moved to the ink receptacle in the vicinity of the home position each time a single reciprocal scanning is completed so as to perform the normal preliminary ejection. As shown in FIG. 8, one cycle of printing operation comprises, after the normal preliminary ejection, (1) printing in a forward direction, (2) change of scanning direction, (3) printing in a backward direction and (4) normal preliminary ejection, all of which are performed on time, and printing of a predetermined amount such as a page is carried out by repeating them. It should be appreciated that a predetermined printing start operation is performed when printing of this predetermined amount is started. This printing start operation includes an operation for ejecting ink from the printing head such as normal preliminary ejection or suction processing. In the above printing operation, as shown in FIG. 8, the time interval from the execution of the normal preliminary ejection or printing start operation to the execution of the next preliminary ejection is set to 1.6 sec. In short, it is so composed to execute the normal preliminary ejection per one cycle of reciprocal scanning, through the design of the printer of the present embodiment.

Here, it is intended to define the longest period of time (also called "rest time" hereinafter) that enables maintaining the state where image data showing "non-ejection" continues from scanning after the normal preliminary ejection, and thereafter no ejection failure occurs in the ink ejection of the first image data showing "ejection" and to then use this time to evaluate the presence or absence of the paper preliminary ejection or the frequency of the paper preliminary ejection. Here, the state where any ejection failure does not occur designates a state where non-ejection phenomenon where ink is not ejected from the nozzle, distortion phenomenon where ink is ejected though not quite satisfactorily but the landing position of this ejected ink is deviated from the regular position, splashing ejection phenomenon due to insufficient ink refill, and so on do not occur.

It should be appreciated that the rest time as defined above varies according to the presence or absence of the paper preliminary ejection or the frequency thereof as shown in Table 1 below, and the rest time becomes longer in the case where the paper preliminary ejection is performed in comparison to the case where paper preliminary ejection is not performed.

The definition of rest time can apply to the case of not performing the paper preliminary ejection or the case of performing the paper preliminary ejection. First, the rest time in the case of not performing the paper preliminary ejection shall be described referring to the example of cyan in Table 1. Here, a rest time of 1.1 sec means that no ejection failure occurs in the first ejection, if the non-ejection period after the normal preliminary ejection is shorter than 1.1 sec. In other words, ejection failure occurs if the non-ejection period from the normal preliminary ejection is equal to or longer than 1.1 sec.

Also, the rest time can be explained as follows when the paper preliminary ejection is executed. In general, the frequency of the paper preliminary ejection is set to be a value lower than the frequency of ink ejection during printing or normal preliminary ejection, so that ink dots on the printing medium through the paper preliminary erection are unremarkable in contrast to the printed image. Therefore, ejection failure may sometimes occur according to the kind of ink even if the paper preliminary ejection is simply executed at a given constant cycle. A rest time of 2.7 sec for cyan in Table 1 means that ejection failure occurs if the non-ejection period is equal to or longer than 2.7 sec even if the paper preliminary ejection is executed by one time of ejection/8 inch. In other words, it comes off without producing ejection failure if the non-ejection period from the normal preliminary ejection is shorter than 2.7 sec. According to this, the time of keeping a better printing state becomes longer comparing to the case without paper preliminary ejection. Thus, it is advantageous in increasing quality of a printed image.

TABLE 1

| | Rest time [s] | | | | |
|---|---|---|---|---|---|
| | Cyan | Magenta | Yellow | Light Cyan | Light Magenta |
| Without paper preliminary ejection | 1.1 | 9.2 | 2.8 | 12.3 or longer | 12.3 or longer |
| With one time of paper preliminary ejection per 8 inch | 2.7 | 12.3 or longer | 12.3 or longer | 12.3 or longer | 12.3 or longer |
| With one time of paper preliminary ejection per 4 inch | 2.7 | 12.3 or longer | 12.3 or longer | 12.3 or longer | 12.3 or longer |

Table 1 shows the rest time according to the presence or absence of the paper preliminary ejection and the frequency of paper preliminary ejection in the case of ejecting respective ink of black, light cyan, cyan, light magenta, magenta and yellow from the ejection orifice 23 of respective printing heads 22K, 22LC, 22C, 22LM, 22M and 22Y (refer to FIG. 1). It should be appreciated that the description of black ink is omitted in Table 1.

As it is evident from Table 1, the rest time of cyan ink in the case of not performing the paper preliminary ejection is 1.1 sec, which is shorter than the time of 1.6 sec from the normal preliminary ejection to the next normal preliminary ejection, shown in FIG. 8. Consequently, the printing head 22C for ejecting cyan ink generates election failure to degrade the printing quality if the printing starts at a time point longer than 1.1 sec, for instance at the time point of 1.5 sec, within 1.6 sec corresponding to the printing time by the aforementioned reciprocal scanning. Therefore, the predetermined paper preliminary ejection shall be performed only for the printing head 22C of cyan ink. This paper preliminary ejection makes the rest time concerning the cyan ink 2.7 sec, preventing the ejection failure from occurring, even if the printing starts within 1.6 sec corresponding to one time interval between consecutive two times of normal preliminary ejection.

In other words, as it is evident from Table 1, with regard to the rest time in the case of not performing the paper preliminary ejection, only cyan ink has the time shorter than 1.6 sec (the black ink of the present embodiment also has the time longer than 1.6 sec similarly to the other ink), so the paper preliminary ejection shall be performed only for the printing head of this ink. Thereby, the paper preliminary ejection is not executed for the other ink, avoiding unnecessary ink consumption provoked by uniform paper preliminary ejection for all colors of ink.

Here, the frequency of paper preliminary ejection for determining the rest time shown in Table 1 above is one time of ejection/8 inch (hence, 1.5 times ejections/sec=3 times ejections/2 sec) and one time ejection/4 inch (similarly, 3 times ejections/sec=6 times ejections/2 sec). It should be appreciated that only one time of paper preliminary ejection based on the pattern shown in FIG. 7 may well be performed per 8 inch in the main scanning direction, if the paper preliminary ejection shall be executed by one time ejection/8 inch. And, only one time of paper preliminary ejection based on the pattern shown in FIG. 7 may well be performed per 4 inch in the main scanning direction, if the paper preliminary ejection shall be executed by one time ejection/4 inch. It should be appreciated that the rest time for the cyan ink in the present embodiment is not different between that in the case where the frequency of paper preliminary ejection is one time ejection/8 inch and that in the case of one time ejection/4 inch. This is mainly due to the property of the ink which relatively tends to increase the viscosity, and thus, the rest time does not increase for such ink even if the frequency of paper preliminary ejection increases. The present embodiment adopts a lower frequency of one time ejection/8 inch for the paper preliminary ejection of cyan ink, so that dots by the same may not be remarkable. It goes without saying that, though the frequency of paper preliminary ejection is shown for one time ejection/8 inch and one time ejection /4 inch, the ejection frequency is not limited to the same. This ejection frequency can be fixed within a range of not highlighting ink dots of preliminary ejection formed on a printing medium.

Second Embodiment

A second embodiment of the present embodiment is a case where there are a plurality of colors of ink requiring the paper preliminary ejection and the frequency of paper preliminary ejection is different depending on these colors of ink.

TABLE 2

| | Rest time [s] | | | | |
|---|---|---|---|---|---|
| | Cyan | Magenta | Yellow | Light Cyan | Light Magenta |
| Without paper preliminary ejection | 1.1 | 1.5 | 1.3 | 12.3 or longer | 12.3 or longer |
| With one time of paper preliminary ejection per 8 inch | 1.5 | 2.7 | 12.3 or longer | 12.3 or longer | 12.3 or longer |

TABLE 2-continued

| | Rest time [s] | | | | |
|---|---|---|---|---|---|
| | Cyan | Magenta | Yellow | Light Cyan | Light Magenta |
| With one time of paper preliminary ejection per 4 inch | 2.7 | 12.3 or longer | 12.3 or longer | 12.3 or longer | 12.3 or longer |

Table 2 shows the rest time according to the presence or absence of paper preliminary ejection and the frequency of paper preliminary ejection, for the present embodiment. As shown in Table 2, the rest time in the case of not performing the paper preliminary ejection is 1.1 sec for cyan ink, 1.5 sec for magenta ink and 1.3 sec for yellow ink, which are shorter than the time interval of 1.6 sec, corresponding to the time interval between consecutive two times of normal preliminary ejection, shown in FIG. 8, for these colors of ink. Therefore, it becomes necessary to perform the paper preliminary ejection. However, for the cyan ink, the rest time is 1.5 sec for the paper preliminary ejection of the frequency of one time ejection/8 inch, and ejection failure may occur if the printing starts after 1.5 sec within the time interval of 1.6 sec. Consequently, the paper preliminary ejection of the frequency of one time ejection/4 inch is performed for cyan ink, and the paper preliminary ejection of the frequency of one time ejection/8 inch is performed for magenta and yellow ink. Thereby, the rest time becomes not shorter than 1.6 sec for any ink, and ejection failure will not occur even if the printing starts in one time interval of consecutive two times of normal preliminary ejection, namely, 1.6 sec corresponding to the time of reciprocal scanning. Also, the paper preliminary ejection is performed at the required minimum frequency according to the color of ink, avoiding unnecessary execution of the paper preliminary ejection at high frequency, and limiting the amount of ink to be consumed by the paper preliminary ejection.

Third Embodiment

A third embodiment of the present invention relates to the application of the paper preliminary ejection to a case of using a printing head that can eject two kinds of ejection amount (volume of ink drop) for a single color of ink.

The above first embodiment corresponds to a case where the volume (ejection amount) of one ink drop ejected from respective ejection orifices is 4 pl. On the contrary, the present embodiment uses a printing head provided with two kinds of ejection orifices for ejecting 4 pl and 8 pl.

Figure 9:
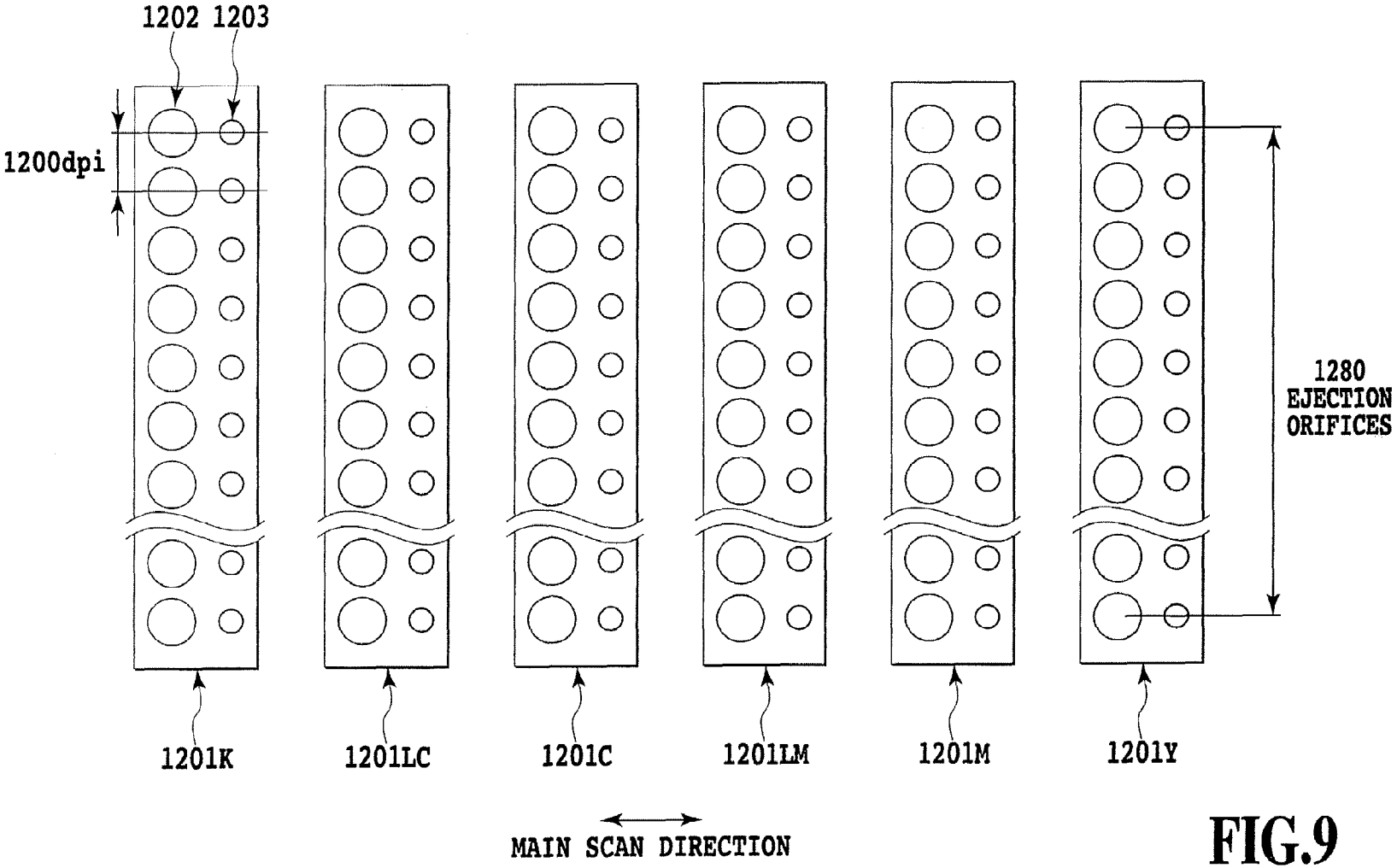
FIG. 9 is a diagram showing ejection orifice arrangement according to a third embodiment of the present invention.

FIG. 9 shows the ejection orifice arrangement of respective ink colors of such a printing head. As shown in the drawing, an ejection orifice 1202 of 8 pl in ejection amount and an ejection orifice 1203 of 4 pl in ejection amount are arranged respectively in printing heads 1201K, 1201LC, 1201C, 1201LM, 1201M, 1201Y of respective colors of ink.

TABLE 3

| | | Rest time [s] | | | | |
|---|---|---|---|---|---|---|
| | | Cyan | Magenta | Yellow | Light Cyan | Light Magenta |
| 4pl | Without paper preliminary ejection | 1.1 | 9.2 | 2.8 | 12. 3 or longer | 12.3 or longer |

TABLE 3-continued

| | | Rest time [s] | | | | |
|---|---|---|---|---|---|---|
| | | Cyan | Magenta | Yellow | Light Cyan | Light Magenta |
| | With one time of paper preliminary ejection per 8 inch | 2.7 | 12.3 or longer | 12.3 or longer | 12.3 or longer | 12.3 or longer |
| 8pl | With one time of paper preliminary ejection per 4 inch | 3.4 | 6.2 | 3.6 | 4.9 | 4.1 |

Table 3 shows the rest time according to the presence or absence of paper preliminary ejection and the frequency of paper preliminary ejection, for each ejection quantity, concerning the present embodiment.

As shown in Table 3, a case where ejection failure may occur if printing starts within time period of 1.6 sec shown in FIG. 8 is a case where ink of ejection amount 4 pl is ejected for cyan ink. Therefore, the present embodiment executes the paper preliminary ejection only from the ejection orifices of ejection amount 4 pl at a frequency of one time ejection per 8 inch. Thus, the paper preliminary ejection is performed only for the ejection orifices according to the ejection amount of respective ink colors, and then unnecessary paper preliminary ejection is prevented to decrease the ink amount used for the paper preliminary ejection.

Other Embodiments

Though, in the aforementioned respective embodiments, a binary paper preliminary ejection pattern is added to the binarized printing data after the index development, data of the paper preliminary ejection pattern may be added to the printing data of index form.

Figure 10:
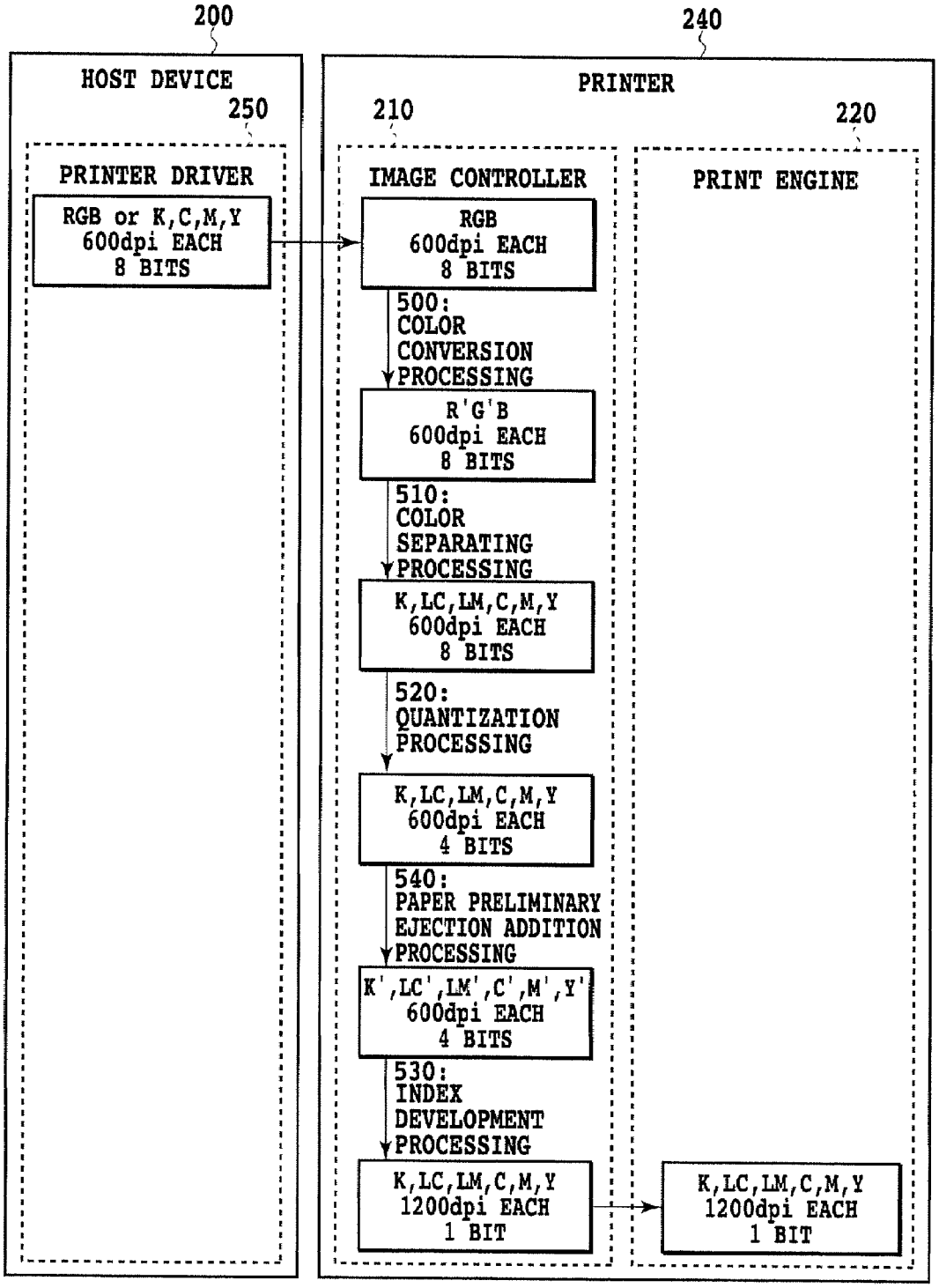
FIG. 10 is a block diagram showing a data processing in the host device 200 and the printer 240, in the case of adding preliminary ejection data of the index form, according to another embodiment of the present invention.

FIG. 10 is a block diagram showing a data processing in the host device 200 and the printer 240, in the case of adding preliminary ejection data of index form, and a similar one to FIG. 5 mentioned above. In short, a similar processing is performed up to the quantization processing 520 of the data transferred from the host device 200 by the printer 240.

Figure 12:
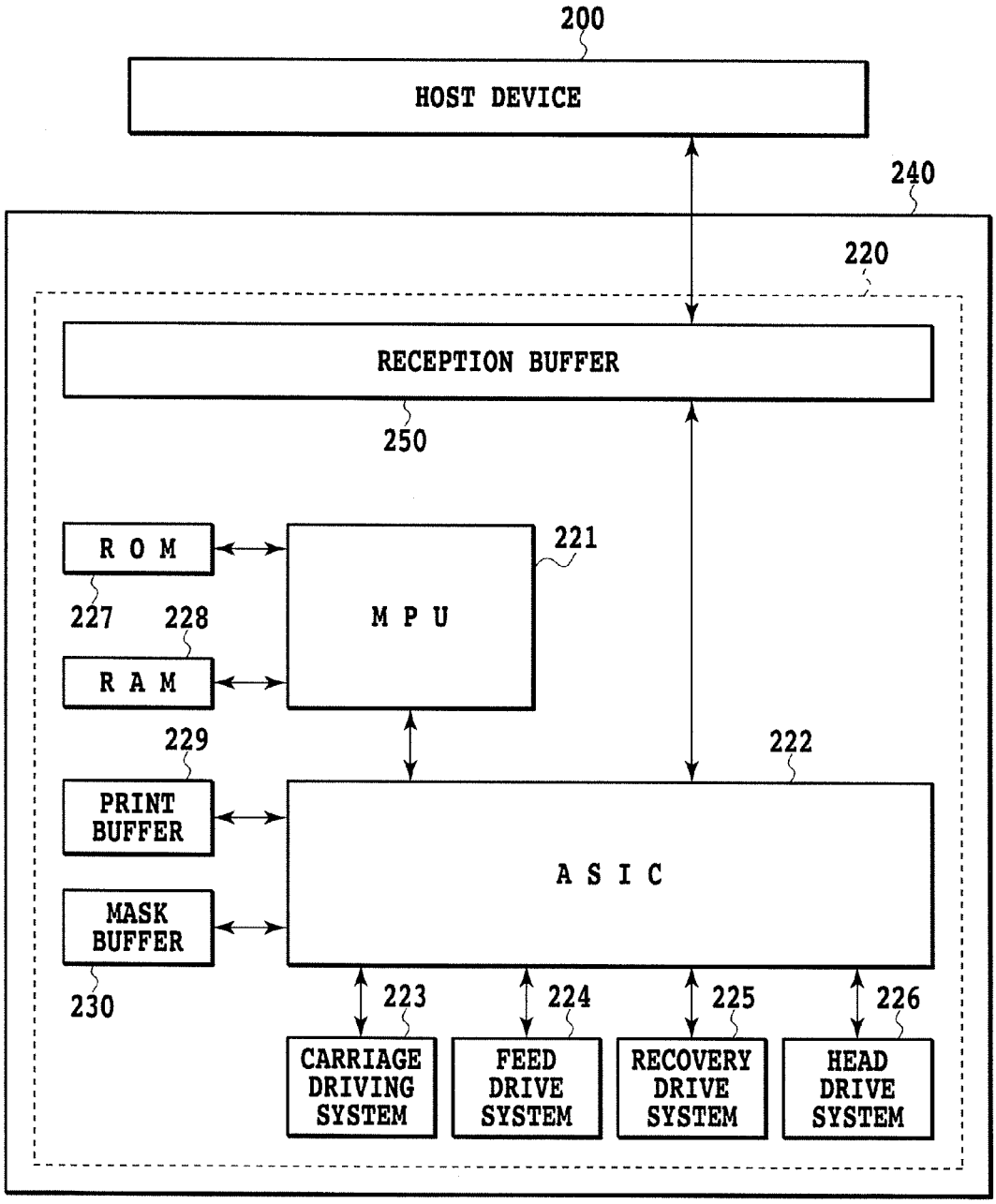
FIG. 12 is a block diagram showing an example of configuration of image processing by a printer driver of the host device, according to still another embodiment of the present invention.

A processing 540 for adding a paper preliminary ejection pattern is executed to 4-bit (5 gradation values) data of quantized K, LC, LM, C, M, Y. More specifically, the 4-bit (5 gradation values) data of quantized K, LC, LM, C, M, Y have any one value among "0000", "0001", "0010", "0011", "0100" as described in FIG. 6. If it has the value of "0001", "0010", "0011", "0100", the paper preliminary ejection data are not added, because ink is ejected to the pixel. On the other hand, in the case of "0000", paper preliminary ejection data as shown in FIG. 12 are added.

Then, the printing data to which the preliminary ejection data are added are converted into printing data of 1-bit (2 gradation values) for respective colors of K, LC, LM, C, M, Y and transferred to the printer engine 220 as printing data containing the paper preliminary ejection data.

Figure 11:
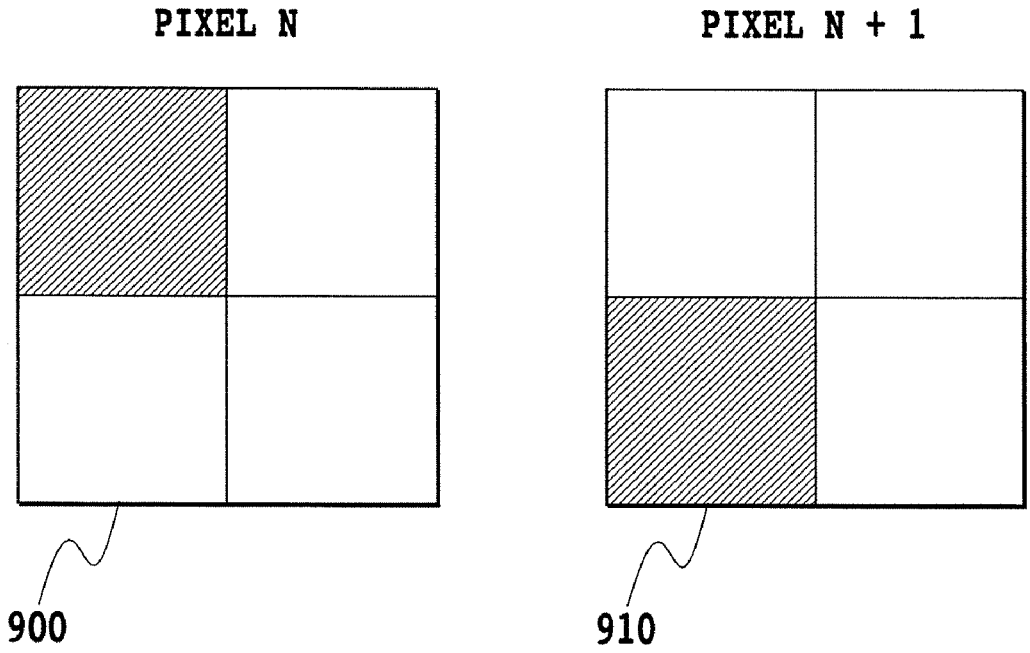
FIG. 11 is a diagram illustrating an index development pattern used for the preliminary ejection.

FIG. 11 is a diagram illustrating an index development pattern used for the preliminary ejection. As shown in the same drawing, two kinds of patterns as shown by pattern 900 and pattern 910 are prepared, as an index development pattern corresponding to 4-bit data of "0001" used as paper preliminary ejection data. It becomes possible to prevent the deflection of the ejection orifice to perform the paper preliminary ejection, by using these two kinds of patterns alternatively.

In addition, the present invention can also be applied to a composition for performing image processing in a printer driver of the host device. FIG. 12, similar to FIG. 4, shows an example of the composition. In this case, it is unnecessary to equip the printer with an image controller for assuming mainly image processing, thereby reducing the cost of the printer.

In this composition, the printing operation starts by sending image data from the host device 200 to a reception buffer 250 of a print engine control section 220. The print engine control section 220 analyzes the image data received from the host device 200 and generates information necessary for the printing such as printing data, printing quality, and margin information. There, printing data, printing quality, margin information or the like are processed by an MPU 221 through an ASIC 222 and held in a RAM 228. Thereafter, this information is referred to as necessary and used for segmenting the process. Furthermore, the mask pattern is written in a mask buffer 230 as necessary. And, printing data to which the data of paper preliminary ejection are added can be created by taking the OR (logical sum) of preliminary ejection data which are preliminary generated and the above, as printing data.

The present invention has been described in detail with respect to preferred embodiments, and it will now be apparent from the foregoing to those skilled in the art that changes and modifications may be made without departing from the invention in its broader aspects, and it is the intention, therefore that the appended claims cover all such changes and modifications as fall within the true spirit of the invention.

This application claims priority from Japanese Patent Application No. 2004-177374 filed Jun. 15, 2004, which is hereby incorporated by reference herein.

What is claimed is:

1. A paper preliminary ejection method, which is used in an ink jet printing apparatus in which ink is ejected from a printing head for ejecting a plurality of kinds of ink to a printing medium to print an image, for performing ink ejection, unrelated to the image to be printed, on the printing medium, said method comprising:

a step for, for each of the plurality of kinds of ink, determining information on predetermined time periods for each of a plurality of frequencies for paper preliminary ejection including a lowest frequency at which no paper preliminary ejection is performed, each predetermined time period being defined as a time period elapsing after an operation of discharging ink from the printing head with the paper preliminary ejection being performed at the corresponding frequency, wherein after the predetermined time period having been elapsed and upon starting of printing a predetermined image, no predetermined degradation of printed image occurs; and a step for, for each of the plurality of kinds of ink, comparing the predetermined time period for each of the plurality of frequencies with a time period from the operation of discharging ink to the next operation of discharging ink, and when the predetermined time period is shorter than the time period from the operation of discharging ink to the next operation of discharging ink, performing the paper preliminary ejection at a frequency higher than a frequency corresponding to the predetermined time period for the corresponding ink.

2. A paper preliminary ejection method as claimed in claim 1, wherein the frequency for the ink corresponding to the predetermined time period which is shorter than the time period from the operation of discharging ink to the next operation of discharging ink is the lowest frequency.

3. A paper preliminary ejection method as claimed in claim 1, wherein the frequency for the ink corresponding to the predetermined time period which is shorter than the time period from the operation of discharging ink to the next operation of discharging ink is a frequency higher than the lowest frequency.

* * * * *

UNITED STATES PATENT AND TRADEMARK OFFICE

CERTIFICATE OF CORRECTION

PATENT NO. : 7,287,825 B2
APPLICATION NO. : 11/150113
DATED : October 30, 2007
INVENTOR(S) : Furuichi et al.

It is certified that error appears in the above-identified patent and that said Letters Patent is hereby corrected as shown below:

COLUMN 1:
Line 48, “Ink” should read --ink--.
Line 59, “referred” should read --referred to--.

COLUMN 3:
Line 16, “an” should be deleted.
Line 41, “occurring:” should read --occurring;--.

COLUMN 4:
Line 59, “refeffed” should read --referred to--.

COLUMN 8:
Line 27, “preliminary” should read --preliminarily--.
Line 47, “quality” should read --quality.--.
Line 59, “dpi” should read --dpi.--.

COLUMN 11:
Line 11, “erection” should read --ejection--.

COLUMN 15:
Line 29, “preliminary” should read --preliminarily--.

Signed and Sealed this

Tenth Day of March, 2009

JOHN DOLL
*Acting Director of the United States Patent and Trademark Office*